US005442532A

United States Patent [19]

Boulos et al.

[11] Patent Number: 5,442,532

[45] Date of Patent: Aug. 15, 1995

[54] DECORATIVE LIGHTING FIXTURE FOR MOTION DETECTION

[75] Inventors: Charles A. Boulos; Syed M. A. Hussain, both of Chino, Calif.

[73] Assignee: Pace Control Technologies, Inc., Chino, Calif.

[21] Appl. No.: 99,732

[22] Filed: Jul. 30, 1993

[51] Int. Cl.[6] ..... F21V 25/00

[52] U.S. Cl. ..... 362/276; 362/269; 362/367; 362/371; 362/432; 362/802; 340/567

[58] Field of Search ..... 340/567, 573; 362/276, 362/418, 427, 432, 802, 147, 269, 285, 287, 289, 367, 370, 371, 374, 375

[56] References Cited

U.S. PATENT DOCUMENTS

| | | | |
|---|---|---|---|
| 2,709,224 | 5/1955 | Garnick | 362/287 |
| 4,939,359 | 7/1990 | Freeman | 340/567 |
| 5,217,296 | 6/1993 | Tanner et al. | 362/802 |
| 5,243,508 | 9/1993 | Ewing et al. | 362/802 |
| 5,258,899 | 11/1993 | Chen | 362/802 |
| 5,282,118 | 1/1994 | Lee | 362/276 |

*Primary Examiner*—Ira S. Lazarus
*Assistant Examiner*—Alan B. Cariaso
*Attorney, Agent, or Firm*—Morton J. Rosenberg; David I. Klein

[57] ABSTRACT

The decorative fixtures of the present invention enable azimuthal directivity of the infrared detector in order to adjust the directivity of the infrared detector about a vertical axis in a manner which is aesthetically compatible with the decorative nature of the fixture. In one embodiment, a hexagonal fixture is turnable about a horizontal axis to pivot not only the infrared detector, but the motion detection circuitry as well. In another embodiment, the motion detection circuitry and the infrared detector are physically separate within the decorative fixture, enabling the infrared detector to pivot within a circular portion of the decorative fixture.

13 Claims, 6 Drawing Sheets

Fig. 1
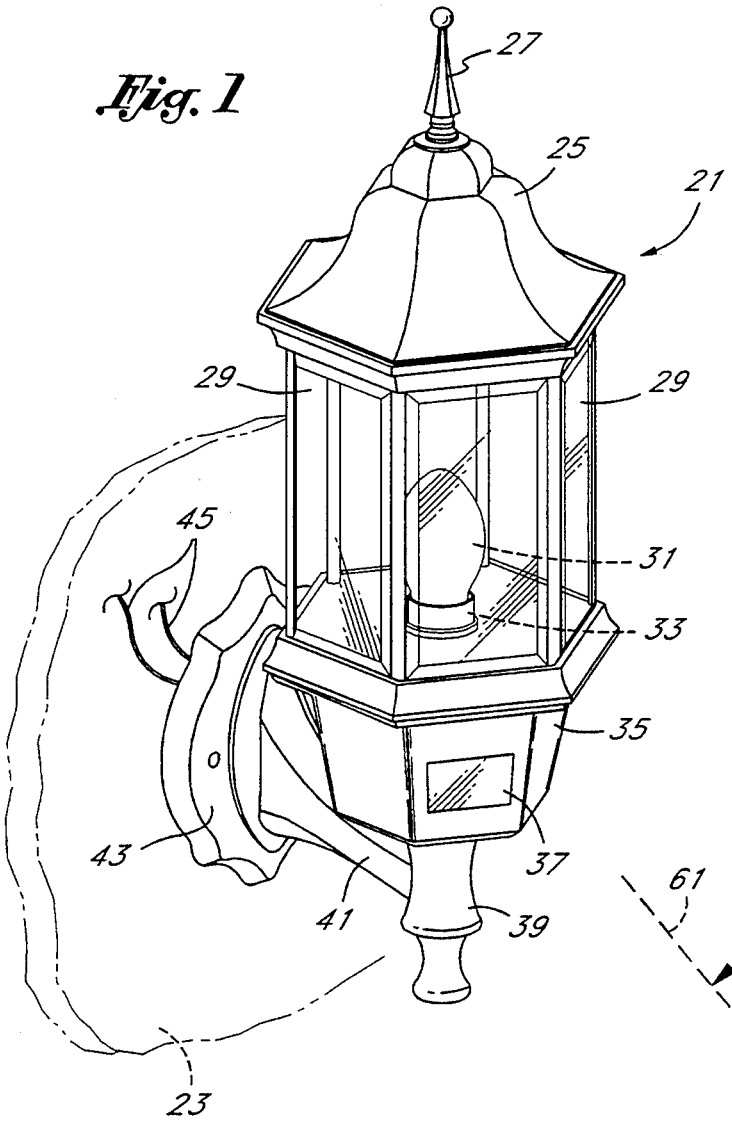
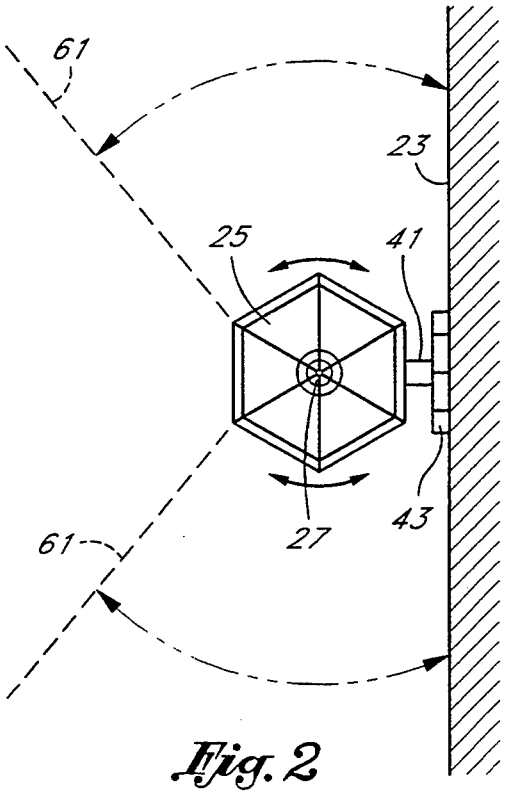
Fig. 2

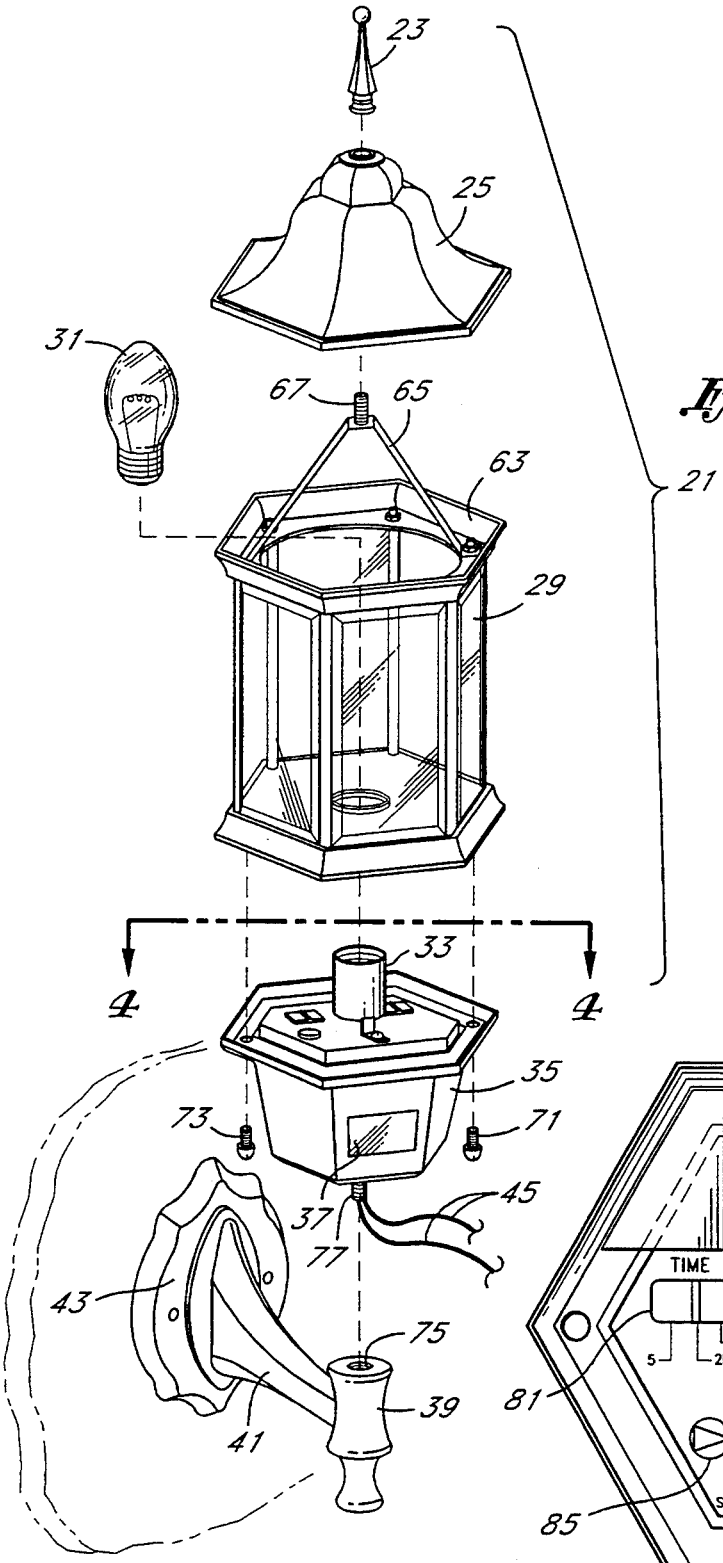
Fig. 3
Fig. 4
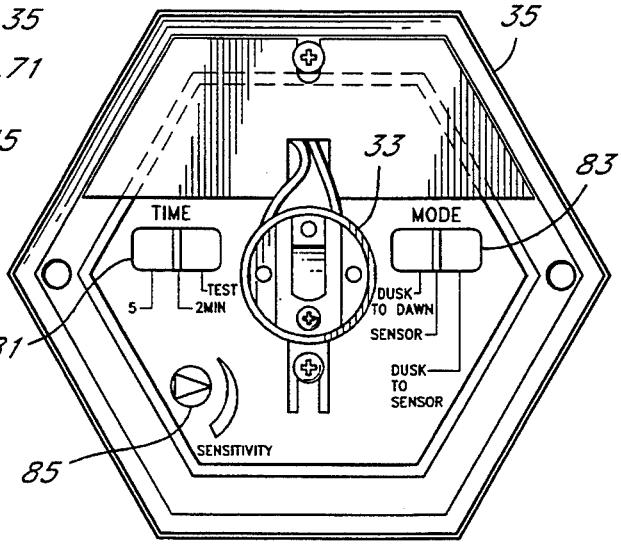

Fig. 6
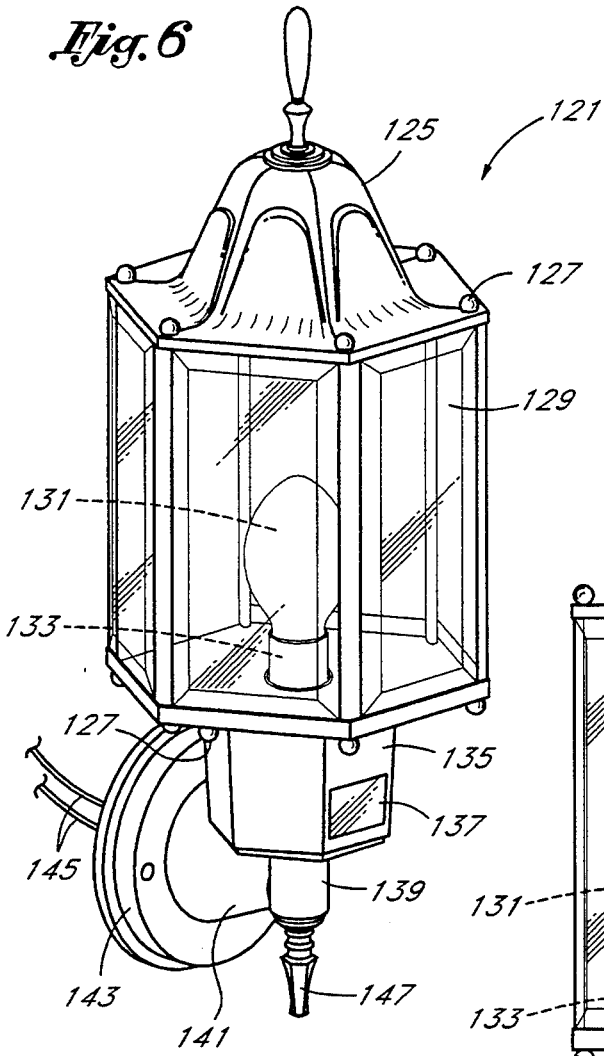
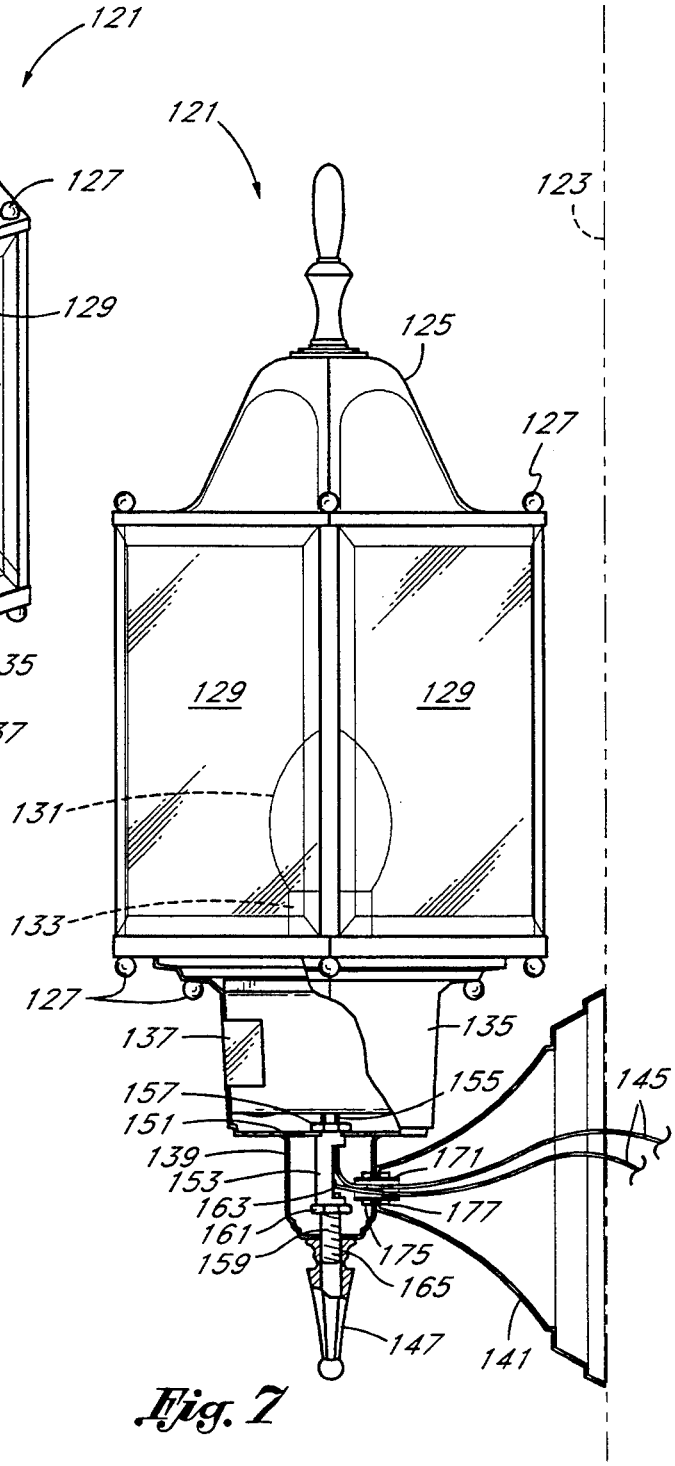
Fig. 7

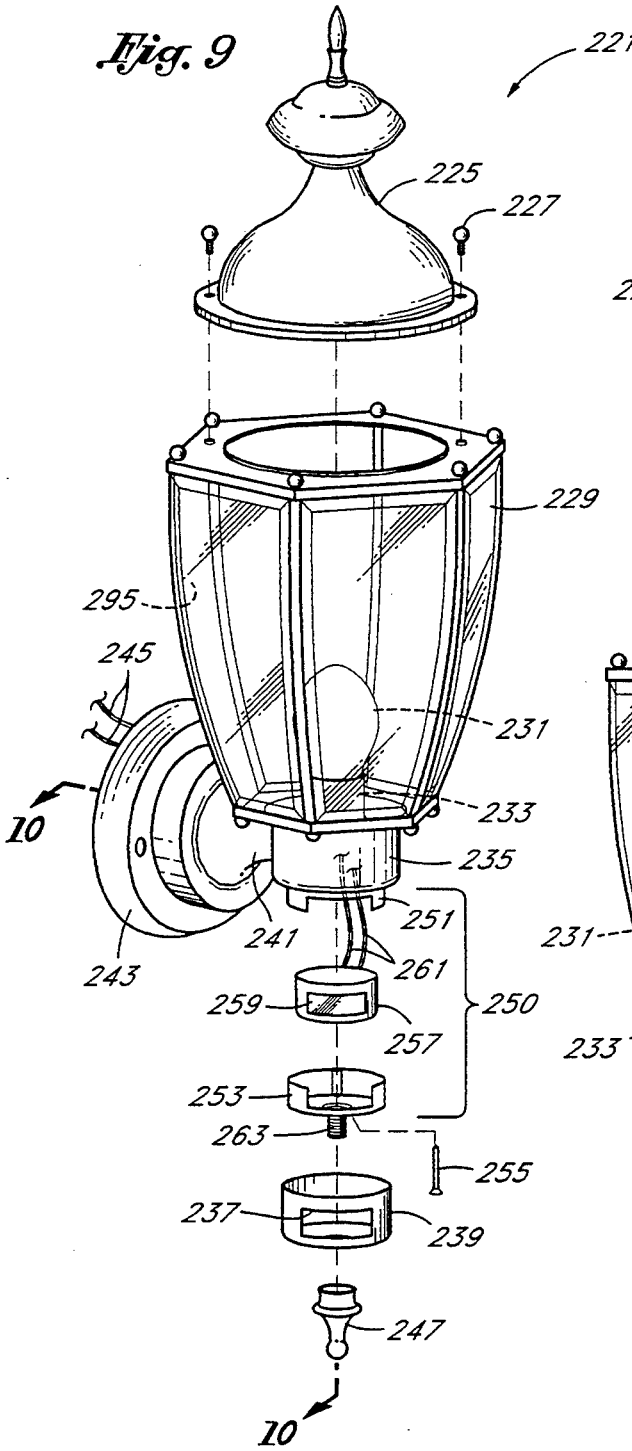
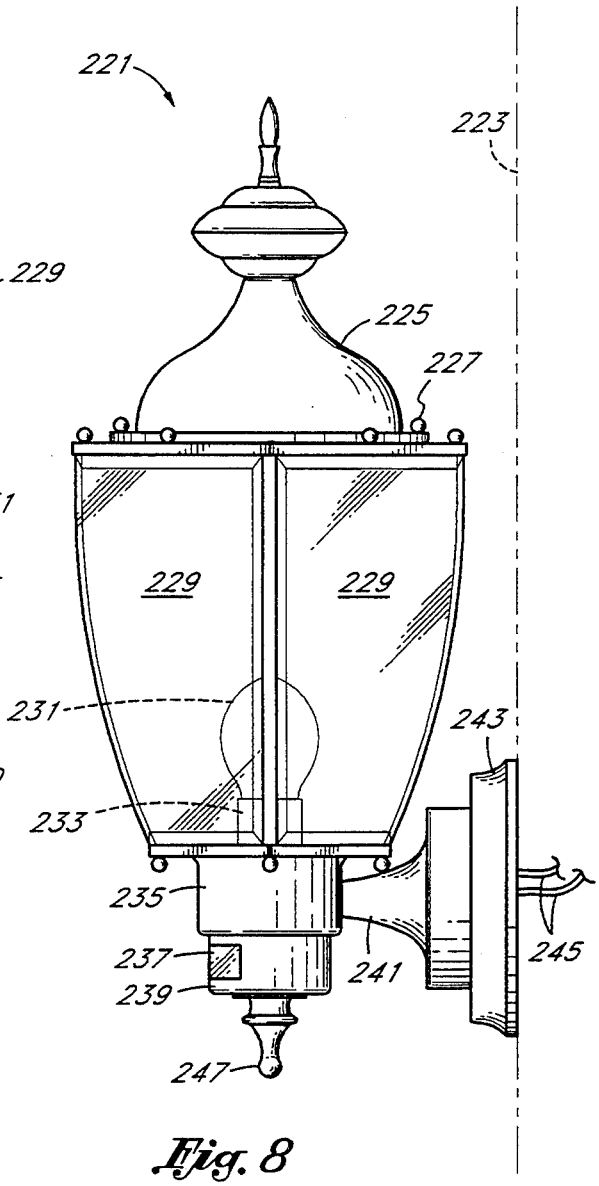
Fig. 8

Fig. 10
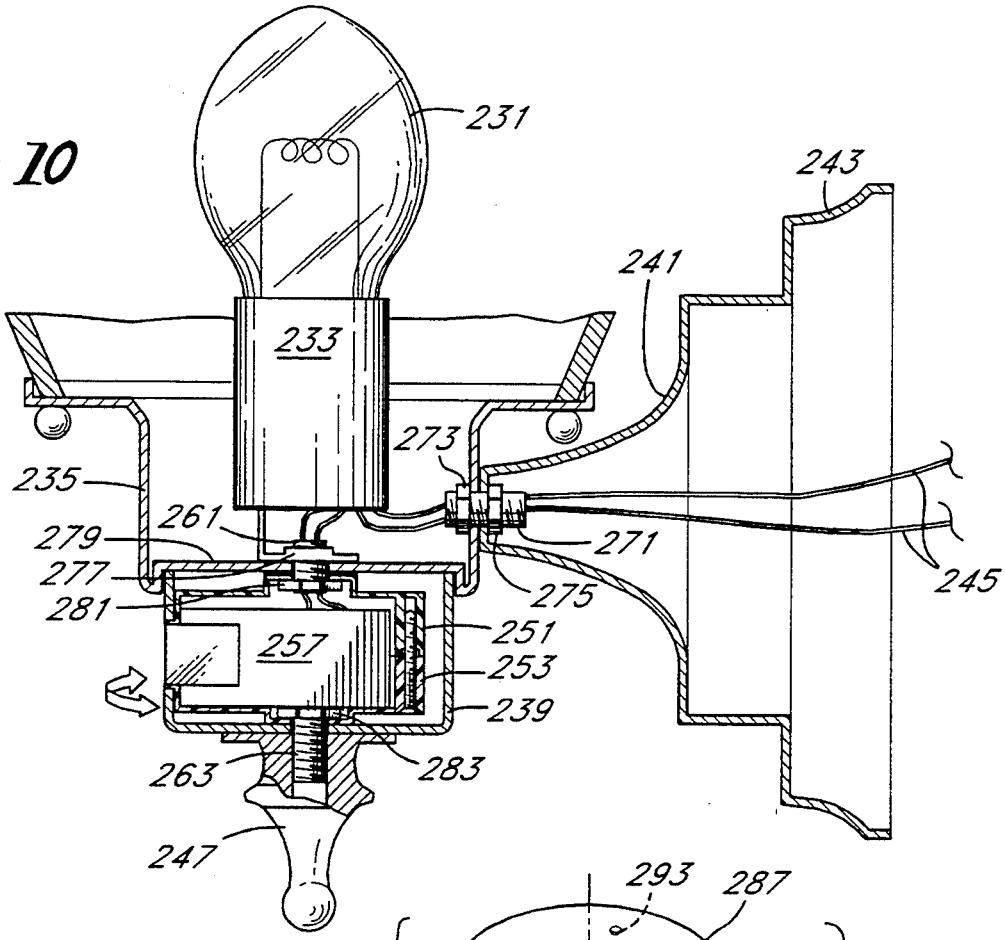
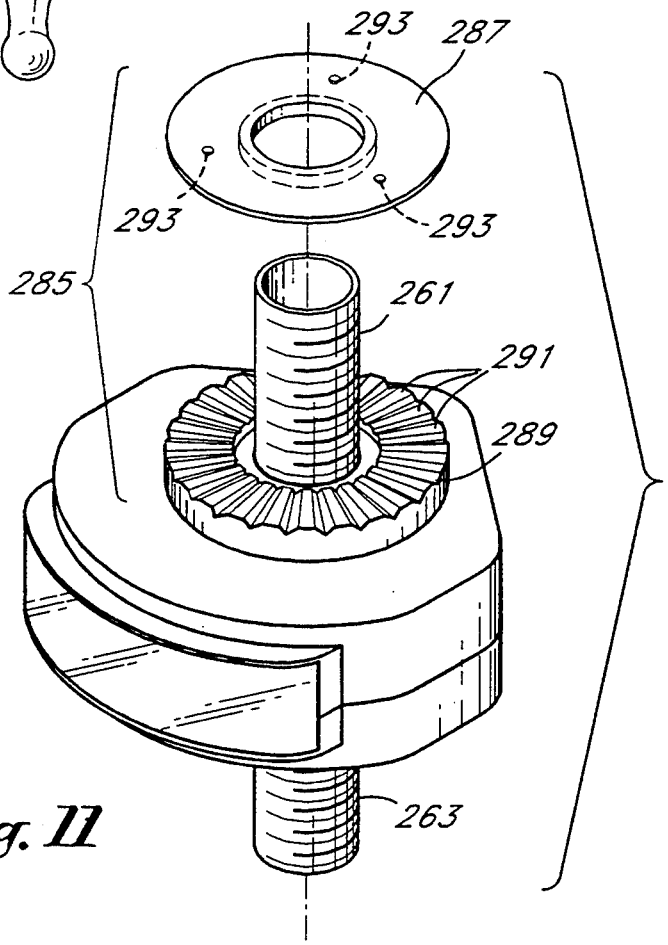
Fig. 11

DECORATIVE LIGHTING FIXTURE FOR MOTION DETECTION

FIELD OF THE INVENTION

The present invention relates to devices designed for use with lighting systems, and particularly for use with elegant, stylish fixtures incorporating a control system for a combination timer and motion detector for use with lighting which turns off the lighting after a certain time period after dark, and turns the lighting back on during the dark period upon detection of motion, while disguising the motion detector and circuitry and without sacrificing the artistic nature of the fixture,

BACKGROUND OF THE INVENTION

Motion detector circuitry has in recent years been incorporated into commercially available lighting fixtures for home and industrial Use. Typically the fixtures will have one or more incandescent bulb fixtures and an electronic motion detector supported by a single base. As has been the usual case for incandescent fixtures, they may be mounted to swivel and turn, such as a ball mounting, so that the light from the incandescent bulbs can be directed.

In some designs, the motion detection housing containing the infrared receiving element has also been mounted to swivel and turn and in some case has been mounted in a ball mounting so that it may be directed into the area most likely to trigger the lighting fixture. In these highly articulated, and modern fixtures, the presence of the infrared receiving element of the motion detector is manifestly noticeable, either in daylight or darkness such as when illuminated from the side by flashlight.

The overt presence of the motion detector circuitry housing, or at least the infrared detector portion of the motion detector can encourage intruders to deliberately bypass the system, or camouflage their presence. It is known, for example, that a heavy jacket covering the extremities of an intruder may allow the intruder to pass by the fixture. Yet the purpose of the fixture is two fold. First its purpose is to surprise the intruder who is then expected to flee. Secondly, the motion detection circuitry is expected to alert anyone in sight of the newly illuminated area to the presence of an intruder. If the light is sufficiently bright, it can also alert the inhabitants of the building upon which the motion detection light is mounted.

Further, the appearance of the modern motion detection fixtures is unsightly. The lighting components are typically directed into the desired areas of illumination while the motion detection component is directed into the area in which maximum sensitivity to motion is to be measured. Articulation of the lighting fixture portions including the light socket fixtures and infrared detector leave the fixture in an off balance, unattractive configuration. Any attempt to manufacture a fixture which attempted to fix or unduly limit the directivity of the infrared motion detection sensor, or which attempted to limit the electric lighting socket fixtures would be unacceptable or unwanted.

In the area of decorative fixtures, the overall appearance is typically designed to give an artistic aesthetic look to the building to which it is mounted. Typically the decorative fixtures are mounted near an building entrance way and are fitted with suitable lighting elements. Since the decorative fixture is typically located near the entrance way, it need not necessarily have swivelable lighting fixture sockets to specifically direct the light. The non-decorative lighting fixtures typically have sockets which are typically used in conjunction with flood lights which emit a highly directional beam of light, and would produce light too harsh for use near an entryway.

Even though decorative lighting usually does not need to have such directional lighting characteristics when it is used with an infrared motion detector it is still desirable to provide it with the practical directivity present in highly articulatable fixtures. However, a fixture with a 19th century gaslight motif will artistically suffer greatly from the presence of an articulated infrared detector suspended anywhere near such light fixture.

It is therefore desirable to hide and disguise such infrared detector, and the infrared motion detection circuitry, into the decorative fixture. Although such circuitry may be hidden elsewhere or may be mountable in the wall supporting the decorative fixture, such is not commercially practical because of increased labor costs and because of the potential incompatibility of the mounting surface to accept and house such separately located circuitry.

What is therefore needed are decorative fixtures which incorporate motion detection circuitry into their housings in such a manner that the presence of motion detection circuitry is concealed. What is also needed is the ability to direct the area of maximum sensitivity of the infrared detector, especially in an azimuthal direction. Where the decorative fixture is usually designed to be mounted near an entrance, and usually at a height of from about six to eight feet from grade, the azimuthal adjustment, particularly needed to be able to direct the area of sensitivity to the area in front of the entrance, is most needed.

SUMMARY OF THE INVENTION

The decorative fixtures of the present invention enable azimuthal directivity of the infrared detector in order to adjust the directivity of the infrared detector about a vertical axis. In one embodiment, a hexagonal fixture is turnable about a vertical axis to pivot not only the infrared detector, but the motion detection circuitry as well. In another embodiment, the motion detection circuitry and the infrared detector are physically separate within the decorative fixture, enabling the infrared detector to pivot and be supported by a circular portion of the decorative fixture. This configuration is advantageous for decorative fixtures which are not radially symmetrical and which would appear odd looking if pivoted about the vertical axis. An example of such fixture might include a reflector.

BRIEF DESCRIPTION OF THE DRAWINGS

Other aspects, features and advantages of the invention, its configuration, construction, and operation will be best understood from the following detailed description, taken in conjunction with the accompanying drawings in which:

FIG. 1 is a perspective view of a first embodiment of a decorative fixture of the present invention;

FIG. 2 is a top view of a first embodiment of a decorative fixture which was shown in FIG. 1;

FIG. 3 is an exploded perspective view of the first embodiment of a decorative fixture of the fixture which was shown in FIGS. 1 and 2;

FIG. 4 is a top view of the hexagonal base housing of the first embodiment of the decorative fixture of FIGS. 1–3;

FIG. 6 is a perspective view of a second embodiment of a decorative fixture of the present invention;

FIG. 7 is a side view of a first embodiment of a decorative fixture which was shown in FIG. 6;

FIG. 8 is a side view of a third embodiment of a decorative fixture of the present invention;

FIG. 9 is a perspective exploded view the third embodiment of decorative fixture which was shown in FIG. 8;

FIG. 10 is a side sectional view of the third embodiment of a decorative fixture of the fixture which was shown in FIGS. 8 and 9; and FIG. 11 is a perspective view of the mechanism shown in FIG. 10.

DETAILED DESCRIPTION

Figure 5:
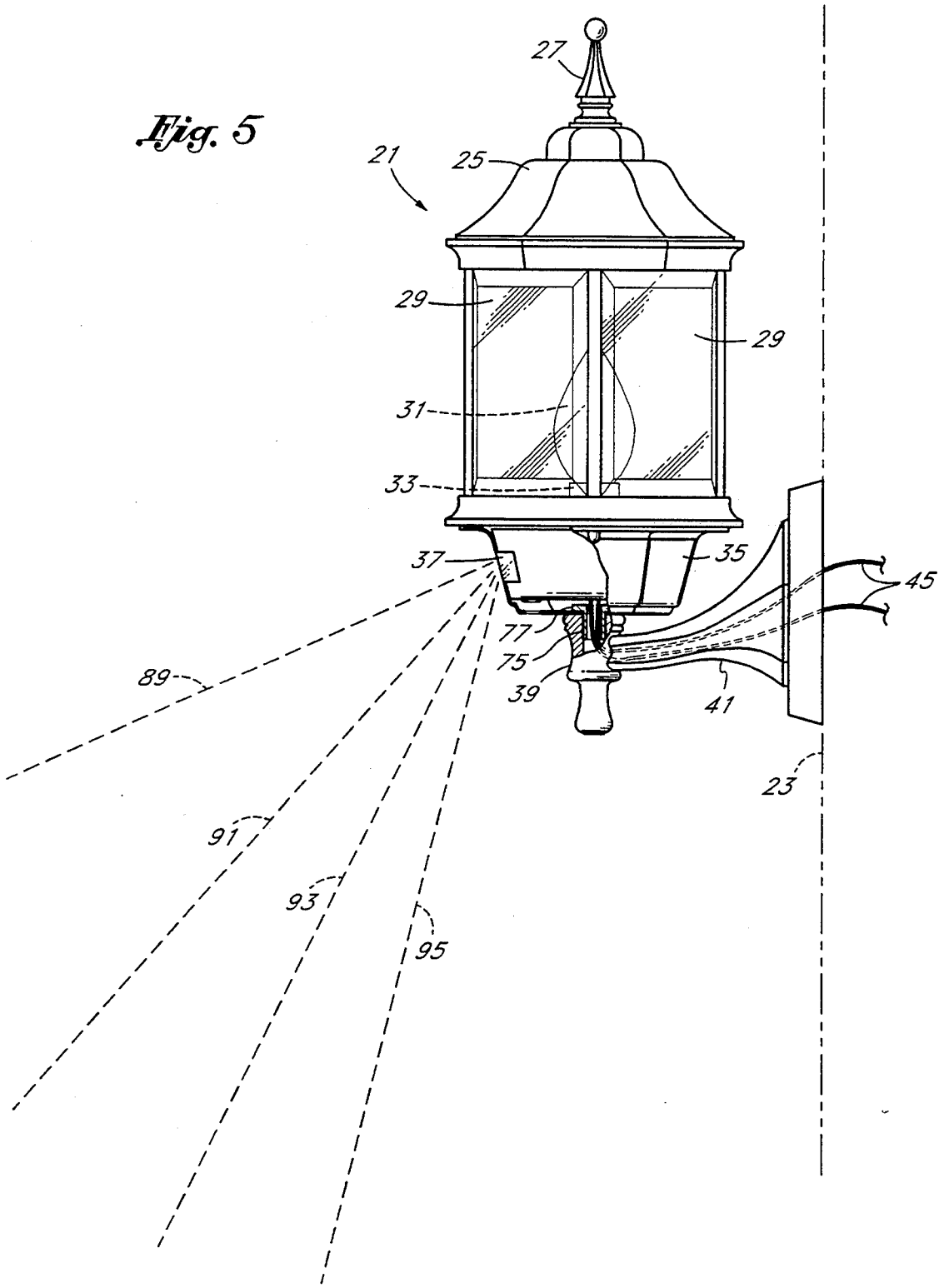
FIG. 5 is a side view of the first embodiment of a decorative fixture of the fixture which was shown in FIGS. 1–4.

Referring to FIG. 1, a lighting fixture 21 is mounted on an outside wall 23, the edges of outside wall 23 shown in phantom. Lighting fixture 21 may range in its degree of ornamentation. Fixture 21 has an upper dome 25 which is usually removable to facilitate the replacement of lamp bulbs if necessary. Upper dome 25 is secured by a removable spindle 27. Beneath the dome 25 is a series of six hexagonally situated windows 29. Concentrically within the extent of the windows 29 is a bulb 31 supported by a socket 33. Bulb 31 may be decorative or ordinary and may range in power as is necessary to illuminate the area in which the fixture 21 is situated.

Note the hexagonal shape of the upper dome 25 and the windows 29. The windows 29 and the bulb 31 is supported by a hexagonal base housing 35. Hexagonal base housing 35 supports the socket 33 and the windows 29 as well as the other upper portions of the fixture 21. On the most prominent hexagonal section of the hexagonal base housing 35 shown in FIG. 1, an infrared window 37 is situated. Infrared window 37 may have a variety of appearances and textures.

Typically infrared window 37 will contain a multi section fresnel lens (not explicitly shown) and which may be mounted to the rear of a material covering the window 37. The fresnel lens is typically a subdivided lens, containing many smaller lenses which focus electromagnetic energy in different directions. The fresnel lens is flat, and depends upon angled projections and the configuration of those projections to focus the electromagnetic energy. In order to disguise the presence of the infrared window 37, a flat plastic sheet of varying color may be placed over the fresnel lens within the infrared window 37. Such a flat plastic sheet may even have a color matching the color of the outside of the fixture 21.

The hexagonal base housing 35 is supported by a vertical bearing 39. Vertical bearing 39 includes an upper portion which is rigidly attached to a support arm 41, and a lower concentrically smaller portion. The support arm 41 is supported by a wall base portion 43 shown affixed to the outside wall 23. A pair of Wires 45 are shown extending beyond the outside wall 23 which provide power both to the infrared detection circuitry within fixture 21 as well as to the bulb 31.

Due to the hexagonal symmetry of the fixture 21, it may be moved in increments of 60° without appearing to have been moved at all. This is because all six of the windows 29 are equivalent to each other, and the fixture 21 is radially symmetric in increments of 60°. The manner in which the fixture 21 may be adjusted involves the support of the hexagonal base housing 35 by the vertical bearing 39. The vertical bearing is rigidly affixed to the support arm 41.

Consequently, the hexagonal base housing 35 pivots with respect to the vertical bearing 39. A hollow threaded member (not yet shown) extends downwardly from the hexagonal base housing 35 and engages a complimentarily internal threaded surface within the vertical bearing 39. Wires 45 extend into the vertical bearing 39 at a point below the end of the hollow threaded member when the hollow threaded member is engaged into the vertical bearing 39. The wires 45 extend upwardly through the hollow threaded member and into the hexagonal base housing 35.

Referring to FIG. 2, a top view of the fixture 21 is shown with respect to the outside wall The range of azimuthal sensitivity is illustrated with the dashed lines 61. The arrows indicate the practical range of pivot to which the fixture 21 can be manipulated. Of course, if the center of sensitivity is left facing the outside wall 23, the motion detection function will not work properly. Because the hollow threaded member (not yet shown) can shift its radial position within the hexagonal base housing 35, it can be adjusted to yield a specified tension at any angular position.

As can be seen in FIG. 2, if an entrance way is located to one side of the fixture 21, the fixture 21 can be rotated to angle the path of infrared sensitivity in the direction of the path leading up to the entrance way. Note also that the wall base portion 43 is securely affixed to the outside wall 23.

Referring to FIG. 3, an exploded view of the fixture 21 is illustrated. Spindle 23 is illustrated as removed from above the dome 25, and dome 25 is shown removed upwardly. As can be seen, the windows 29 are supported by a framework 63. At the upper portion of the framework 63, an "A" frame 65 has its legs affixed to the upper portion of the framework 63, and a threaded portion 67 for engaging the spindle 23.

A pair of screws 71 and 73 engage the framework 63 to the hexagonal base housing 35. The internal threaded surface 75 of the vertical bearing 39 can be seen, as can the hollow threaded member 77 having external threads engageable with the internal threaded surface 75 of the vertical bearing 39.

Referring to FIG. 4, one possible configuration of motion detection controls are shown mounted on the upward face of the hexagonal base housing 35. A time switch 81 sets the time duration of illumination of the bulb 31 upon detection of infrared motion. As is shown, the times selectable are five minutes, two minutes and "test" which usually corresponds to a time period of zero minutes which is usually used to test the motion detector.

A mode switch 83 is used to select the operating mode. The modes illustrated include "dusk to dawn," "sensor," and "dusk to sensor." These modes correspond to operation as a dusk to dawn light only, without the sensing of motion; sensor operation irrespective of the level of ambient light; and finally sensor operation only between the hours of dusk and dawn.

Also shown is a sensitivity setting 85 which enables the setting of the sensitivity of the infrared detector of the motion detection circuitry. High sensitivity corresponds to an operation where only a slight detection will trigger the bulb 31. Low sensitivity corresponds to an operation where only a direct, highly significant detection will trigger the bulb 31. In FIGS. 1–4 it is clear that all of the required electronics and sensors are included within the hexagonal base housing 35. This would normally also include an ambient light sensor (not shown), and an aperture located somewhere on the fixture 21, typically in the hexagonal base housing 35 to admit light to the ambient light sensor.

Referring to FIG. 5, a side view of the first embodiment of the fixture 21 is illustrated showing in detail the path of the wires 45. Also shown in sectional view is the hollow threaded member 77 and its engagement with the internal threaded surface 75 of vertical bearing 39. Further shown in FIG. 5 is the general elevational lines of sensitivity represented by dashed lines 89, 91, 93, and 95. The elevational lines of sensitivity 89, 91, 93, and 95 are created by forming the fresnel lens (not shown) in such a way that the sensitivity deviates from a line normal to the infrared window 37. In FIG. 5, the line of sensitivity 95 which points downwardly is the one most severely deviated from a line normal to the infrared window 37.

As is clear from the foregoing description, the elevational sensitivity is pre-set depending upon the configuration of the fresnel lens residing within the infrared window 37. However, the fresnel lens can be turned in the plane of the infrared window 37 to cause the lines of sensitivity to extend predominately upwardly, if desired. Further, the fixture 21 may be provided with a series of fresnel lenses which provide an array of different elevation and azimuthal characteristics. This is not unduly costly, since the fresnel lens is typically only a thin sheet of plastic impressed with graded index portions which form the lenses for each of the "zones" to be sensed in front of the fixture 21.

Referring to FIG. 6, a second embodiment of the decorative lighting fixture for motion detection of the present invention is illustrated. This fixture 121 is also mountable on an outside wall 123, shown in FIG. 7 but not in FIG. 6, for clarity. Lighting fixture 121 is somewhat more ornamental than was lighting fixture 21. Fixture 121 has an upper dome 125 which is usually removable to facilitate access to the interior of fixture 121. Upper dome 125 is secured by a pair of removable bolts 127. Beneath the dome 125 is a series of six hexagonally situated windows 129. Concentrically within the extent of the windows 129 is a bulb 131 supported by a socket 133. As was the case for bulb 31, bulb 131 may be decorative or ordinary and may range in power as is necessary to illuminate the area in which the fixture 121 is situated.

Again, the upper dome 125 is hexagonal shaped as are the windows 129. The windows 129 and the bulb 131 are supported by a hexagonal base housing 135. Hexagonal base housing 135 supports the socket 133 and the windows 129 as well as the other upper portions of the fixture 121. 0n the most prominent hexagonal section of the hexagonal base housing 135 shown in FIG. 6, an infrared window 137 is situated. Infrared window 137 will contain a multi section fresnel lens as was discussed for infrared window 37.

The hexagonal base housing 135 is supported by a vertical collar 139. Vertical collar 139 is rigidly supported by a support arm 141. The support arm 141 is supported by a wall base portion 143. A pair of wires 145 are shown extending into the wall base portion 143. Wires 145 provide power both to the infrared detection circuitry as well as to the bulb 131.

Referring to FIG. 7, a side view of the fixture 121 illustrates further details of its construction. Shown is the wall 123. Adjacent the vertical collar 139 on the lower side is an adjustment spindle 147. Since the Vertical collar 139 is affixed to the support arm 141, the adjustment spindle 147 can be used to engage the hexagonal base housing 135 to rotationally fix the hexagonal base housing 135 to the vertical collar 139.

Referring to the details of FIG. 7, the hexagonal base housing 135 has a base plate 151. A wiring access cylinder 153 has an upper threaded portion 155 secured by a hex nut 157 and a lower threaded portion 159, which may be fitted with a hex nut 161. Wiring access cylinder 153 has an open slot 163 which is shown accommodating the wires 145. Open slot 163 is wide and long enough to permit it to be angularly displaced with respect to the vertical collar 139 without damage to the wires 145.

The lower portion of the lower threaded portion 159 is engaged by the adjustment spindle 147 which has an internally threaded area 165 at the upper end of the adjustment spindle 147. Tightening the adjustment spindle 147 places the vertical collar 139 in tension between the upper surface of the adjustment spindle 147 and the plate 151 of the hexagonal base housing 135.

At the point where the vertical collar 139 is connected to the support arm 141, a horizontally oriented hollow threaded member 171 secures the vertical collar 139 to the support arm 141 with a first nut 175 within the vertical collar 139 and a second nut 177 within the support arm 141. Note that hollow threaded member 171 accommodates the wires 145 within its inner area.

In the second embodiment of FIGS. 6 and 7, an adjustment may be easily made by hand loosening the adjustment spindle 147 to release the tension on the vertical collar 139. The,hexagonal base housing 135 can then be rotated to orient the light fixture 121 and its infrared window 137 as desired. Once the desired position is achieved, the adjustment spindle 147 is re-tightened to again fix the angular position of the hexagonal base housing 135. Note that the interface between vertical collar 139 and the base plate 151 involves a flaring of the material at the upper end of vertical collar 139. The flaring of the metal interface helps to disguise the sectional nature of the fixture 121.

Referring to FIG. 8, a third embodiment of the decorative lighting fixture for motion detection of the present invention is illustrated. This fixture 221 is also mountable on an outside wall 223. Lighting fixture 221 has a slightly greater internal lighting volume than either of the fixtures 21 or 121. Fixture 221 has an upper dome 225 which is usually removable to facilitate the replacement of lamp bulbs if necessary. Upper dome 225 is secured by a pair of removable bolts 227. Beneath the dome 225 is a series of five hexagonally situated windows 229. The sixth hexagonal section is a mirror or highly reflective metal section (not visible in FIG. 8) having the same overall shape as the windows 229. Concentrically within the extent of the windows 229 is a bulb 231 supported by a socket 233. As was the case for bulbs 31 and 131, bulb 231 may be decorative or ordinary and may range in power as is necessary to illuminate the area in which the fixture 221 is situated.

Again, the upper dome 225 is circularly shaped even though the windows 229 are hexagonally shaped. The windows 229 and the bulb 231 are supported by a round base housing 235. Round base housing 235 supports the socket 233 and the windows 229 as well as the other upper portions of the fixture 221. The infrared window 237 is mounted beneath the round base housing 235 is a turret 239. Turret 239 is pivotable with the window 237 about its vertical axis. Turret 239 is well supported by the round base housing 235 because of the solid support provided round base housing 235 by a support arm 241. The support arm 241 is supported by a wall base portion 243. A pair of wires 245 are shown extending into the wall base portion 243. Wires 245 provide power both to the infrared detection circuitry as well as to the bulb 31.

Beneath the turret 239 is an adjustment spindle 247. Here, adjustment spindle 247 engages a lower hollow threaded member 249. The adjustment spindle 247 engages the turret 239 against the lower portion of the round base housing 235 in much the same way that the adjustment spindle 147 was used to engage the hexagonal base housing 135 to rotationally fix the hexagonal base housing 135 to the vertical collar 139. In this instance, however, the force necessary to prevent the pivoting of the turret 239 is slight.

Further, and as is shown in FIG. 9, an infrared receiver support structure 250 includes an upper housing 251 engageable with a lower housing 253 using a threaded screw 255. The actual infrared receiver portion is illustrated as a cylindrical infrared detector housing 257 and having a detector opening 259, and a pair of conductor leads 261. Note also that the upper housing 251 has an upper hollow threaded member 261, while lower housing 253 has a lower hollow threaded member 263.

Referring to FIG. 10, at the point where the round base housing 235 is connected to the support arm 241, a horizontally oriented hollow threaded member 271 secures the round base housing 235 to the support arm 241 with a first nut 273 within the round base housing 235 and a second nut 275 within the support arm 241. Note that hollow threaded member 271 accommodates the wires 245 within its inner area.

FIG. 10 also shows a series of nuts which engage the upper and lower hollow threaded members 261 and 263, respectively. An integral nut/socket support 277 engages the upper hollow threaded member 261 against a lower plate 279 within round base housing 235. Another nut 281 engages the upper hollow threaded member 261 against the upper housing 251 of the infrared receiver support structure 250. Another nut 283 engages the lower hollow threaded member 263 against the lower housing 253 of the infrared receiver support structure 250. The spindle 247 engages the other end of the lower hollow threaded member 263 against the lower surface of the turret 239 and the upper surface of the turret 239 against the round base housing 235.

Referring to FIG. 11, an expanded view of the upper and lower housings 251 and 253 of the infrared receiver support structure 250 is shown and illustrating a plastic detent mechanism 285, including an upper detent plate 287 and a lower detent plate 289. Both the upper and lower detent plates 287 and 289 fit around the upper hollow threaded member 261.

Lower detent plate 289 has a series of raised ribs 291. Upper detent plate 289 has a series of downwardly directed dimples 293, the reverse sides of which are visible. These dimples 293 fit within the spaces between the raised ribs 291 to provide a detent action as the infrared receiver support structure 250 is angularly displaced. In this manner, a series of fixed positions may be selected, and which will not be much affected by the tightening of the adjustment spindle 247. This is especially useful since the turret 239 will typically tend to turn freely if the spindle 247 is loosened, absent the presence of the detent mechanism 285.

The open space between the upper hollow threaded member 261 and the lower hollow threaded member 263 accommodates the cylindrical infrared detector housing 257 and its pair of conductor leads 261 to enable the conductor leads to pass through the upper threaded member 261. This configuration enables the motion detection electronics (not shown) to also be located within the wall base portion 243.

Without the necessity to turn the whole upper portion of the fixture 221, the fixture 221 can be made more efficient, in this case by the placement of a mirror or polished metal surface section 295 at the rear of the fixture 221, as is shown in FIG. 9. The surface section 295 reflects light which would otherwise illuminate that portion of the outside wall 223 immediately to the rear of the fixture 221.

Fixture 221 may be adjusted by loosening the adjustment spindle 247, manually turning the turret 239 against the detent mechanism 285, and then re-tightening, by hand the adjustment spindle 247.

Although the invention has been described with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed is:

1. A light fixture employing motion detection circuitry comprising:

base housing means for housing motion detection circuitry including a motion detection sensor, said base housing means including a hollow support having a surrounding wall and a base plate portion having an aperture;

support means for supporting said base housing means, said base housing means being selectively and rotatably displaceable about a vertical axis to control the azimuthal orientation of said motion detection sensor, said support means including (1) a support having a wall base portion for mounting on a generally vertical wall, (2) a support arm portion extending from said base portion, and (3) a vertical bearing portion having an internally threaded generally vertical bore supported by said support arm portion;

encasement means for encasing a light emitting appliance, said encasement means being secured to said base housing means; and, means for removing said encasement means from said base housing means, said means for removing said encasement means including a threaded member threadedly engaging said base plate portion and said encasement means and said vertical bore of said vertical bearing portion.

2. The light fixture recited in claim 1 wherein said encasement means further comprises means for selectably opening said encasement means.

3. The light fixture recited in claim 1 further comprising:

motion detection and light emitting appliance control circuitry; and power supply wiring connected to said motion detection and light emitting appliance control circuitry and extending through said hollow threaded member of said base housing means and said support arm portion of said support.

4. A light fixture employing motion detection circuitry comprising:

base housing means for housing motion detection circuitry including a motion detection sensor, said base housing means including a hollow support having a surrounding wall and a base plate portion having an aperture;

support means for supporting said base housing means, said base housing means being selectively and rotatably displaceable about a vertical axis to control the azimuthal orientation of said motion detection sensor, said support means including:

a. a support having a wall base portion for mounting on a generally vertical wall including a conic portion defining a connecting aperture formed through a tip end of said support;

b. a vertical bearing portion having a connecting aperture formed in a side wall thereof; and, c. a first hollow threaded member positioned within said aperture of said vertical bearing portion and said aperture of said tip end of said support;

encasement means for encasing a light emitting appliance, said encasement means being secured to said base housing means; and, means for removing said encasement means from said base housing means, said means for removing said encasement means including a threaded member threadedly engaging said base plate portion and said encasement means.

5. The light fixture recited in claim 4 wherein said base housing means further comprises:

a second hollow threaded member having a first end, a second end, an elongate slot between said ends, said first end extending through said aperture of said base plate portion and secured with a nut, said second hollow threaded member extending through said vertical bearing; and an adjustment spindle having an internally threaded bore and threadably matable with said second end of said second hollow threaded member.

6. The light fixture recited in claim 5 further comprising:

motion detection and light emitting appliance control circuitry within said base support; and power supply wiring connected to said motion detection and light emitting appliance control circuitry and extending through said first end and said elongate slot of said second hollow threaded member and said first hollow threaded member.

7. The light fixture recited in claim 6 wherein an upper portion of the side walls of said vertical bearing are flared.

8. The light fixture recited in claim 6 wherein said motion detection and light emitting appliance control circuitry further comprises means for detecting the ambient light level.

9. A light fixture employing motion detection circuitry comprising:

base wall support means for securing said light fixture to a wall;

base housing means secured to said base wall support means, for supporting an electrical lighting connector, said base housing means having a bottom surface having an aperture formed therethrough;

encasement means for encasing a light emitting appliance, supported by said base housing means;

motion detector support means, supported by said base housing means, for supporting and enabling a preselected azimuthal orientation for a motion detector, said motion detector support means including a first hollow threaded member having a first end axially secured by said bottom surface and extending through said aperture, said first hollow threaded member having an opposing second end, a motion sensor housing having an upper aperture for accepting and axially securing said second end of said first hollow threaded member, said motion sensor housing having a lower aperture formed therethrough, a second hollow threaded member having a first end and a second end, said first end axially secured by said lower aperture of said motion sensor housing and extending through said lower aperture, an adjustment spindle having an internally threaded bore and threadedly engaged to said second end of said second hollow threaded member.

10. The light fixture recited in claim 9 wherein said base housing means includes a bottom surface defining an aperture and said motion detector means further comprise:

a first hollow threaded member having a first end axially secured by said bottom surface and extending through said aperture, and having a second end;

a motion sensor housing having an upper aperture for accepting and axially securing said second end of said first hollow threaded member, and having a lower aperture;

a second hollow threaded member having a first end axially secured by said lower aperture of said motion sensor housing and extending through said lower aperture, and having a second end; and an adjustment spindle having an internally threaded bore and threadably matable with said second end of said second hollow threaded member.

11. The light fixture recited in claim 9 wherein said motion detector support means further comprising:

said first hollow threaded member having an elongate slot between said first and second ends, said first end extending through said aperture of said bottom surface of said base housing means;

said motion sensor housing having an upper aperture and a lower aperture for accepting said first hollow threaded member, at least a portion of said elongate slot exposed to the interior of said motion sensor housing;

said adjustment spindle having an internally threaded bore and threadably matable with said second end of said first hollow threaded member.

12. The light fixture recited in claim 11 further comprising detent means located between said motion sensor housing and said base housing means for quantizing the stable azimuthal angular displacement of said motion sensor housing with respect to said base housing means.

13. The light fixture recited in claim 11 further comprising:

motion detection and light emitting appliance control circuitry supported within said base wall support means;

motion detection means supported within said motion sensor housing; and signal wiring connected between said motion detection and light emitting appliance control circuitry and said motion detection means and extending through said first end and said elongate slot of said hollow threaded member.

* * * * *